United States Patent [19]

del Fabro

[11] 4,379,511

[45] Apr. 12, 1983

[54] DEVICE FOR DRAWING LIQUIDS FROM CONTAINERS

[75] Inventor: Mario F. del Fabro, Santiago, Chile

[73] Assignee: Fiora del Fabro Y Cia. Ltda., Santiago, Chile

[21] Appl. No.: 259,196

[22] Filed: Apr. 30, 1981

[30] Foreign Application Priority Data

May 9, 1980 [CL] Chile ..... 308/80

[51] Int. Cl.[3] ..... B65D 83/00

[52] U.S. Cl. ..... 215/1 A; 239/33

[58] Field of Search ..... 215/1 A; 239/33, 24

[56] References Cited

U.S. PATENT DOCUMENTS

| | | | |
|---|---|---|---|
| 1,253,579 | 1/1918 | Deanes | 215/1 A |
| 1,309,994 | 7/1919 | McAuliffe | 239/33 X |
| 2,288,848 | 7/1942 | Schuessler | 239/33 |
| 2,531,855 | 11/1950 | Loptson | 239/33 |

*Primary Examiner*—Donald F. Norton

*Attorney, Agent, or Firm*—Cushman, Darby & Cushman

[57] ABSTRACT

A device through which liquid can be drawn having at least one extended open channel member having flotation means connected thereto at a predetermined position.

13 Claims, 7 Drawing Figures

DEVICE FOR DRAWING LIQUIDS FROM CONTAINERS

SUMMARY AND BACKGROUND OF THE INVENTION

The invention relates to devices through which a liquid can be drawn from a container.

Using a straw to consume beverages such as fruit juices, soft drinks and the like is known. Already known drinking straws are open ended cylinders or tubes. Such already known straws are typically made from plastic or wax impregnated paper. However, these straws require the user to first open the container and only then insert the straw. After consuming the beverage, the user must remove and then discard the straw.

According to the present invention, the device can be used for drinking soft beverages, usually served in containers, preferably bottles, such as milk, fruit juices and other drinkable liquids, carbonated or not, creamy or oily. The device includes at least one open outer channel and a flotation device connected thereto at a predetermined position. While this straw can be used by itself I prefer to have the device can be used in combination with a container. In such applications, the device can be sealed along with a liquid inside an openable container. Upon opening the container, the device spontaneously emerges from the sealed bottle and will extend upwardly from the dispensing aperture of the open container a distance sufficient to permit normal usage.

The device according to the present invention is suitable for use in removing a wide variety of consumable liquids as well as other liquids perhaps even including chemicals from various types of containers if the appropriate precautions are taken to prevent spillage or splashing. In such cases the device is made from appropriate chemically inert material such as a plastic or thermoplastic as well as other materials that can be easily extruded.

The straw should be made from physiologically harmless and innocuous material, such as polyethylene, that is inert to acidic liquids and carbonic acid.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PREFERRED EMBODIMENT OF THE PRESENT INVENTION

Figure 1:
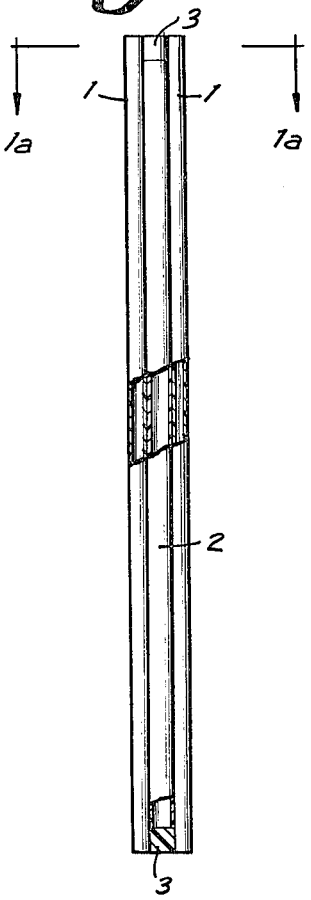
FIG. 1 shows a diagrammatic side elevation of the device according to the present invention.
Figure 1A:
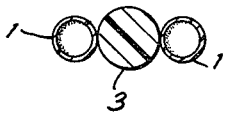
FIG. 1A is a view of the device of FIG. 1 along line 1A—1A.

In FIG. 1, the device comprises two lengths of outer open channels 1 and a central flotation member 2. As shown, flotation member 2 is hollow and the ends 3 are hermetically sealed to provide a liquid-tight chamber relative to the liquid contained in the bottle or other receptacle. Sealing is not required if the flotation member is made from a piece of solid material having a density less than that of the liquid being drawn through outer channels 1.

Figure 2:
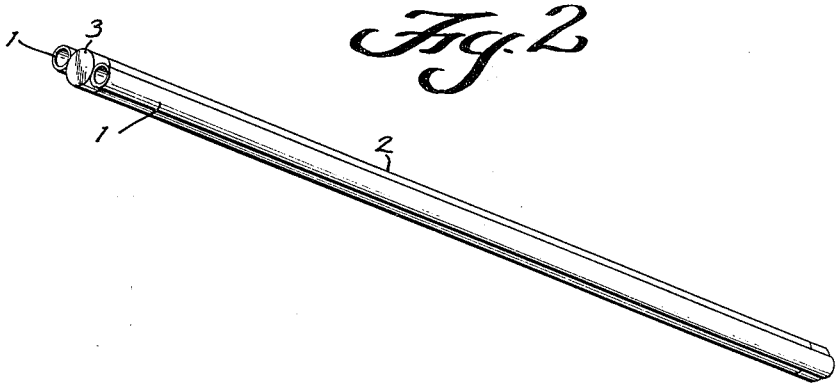
FIG. 2 is a diagrammatic perspective view of the device shown in FIG. 1.

In FIGS. 1 and 2, the outer channels 1 and flotation member 2 are joined together along the whole of their length while allowing the outer channels 1 to provide a free passage for the liquid. However, other forms of a flotation device could be used as well, it only being important to assure the straw will be able to rise up out of the bottle or container.

In that regard, it should be understood that flotation member 2 can be a flotation chamber having a length similar to the length of the outer channel 1 and having a diameter which can be equal to, or somewhat larger than the diameter of the outer channel 1.

Alternatively, flotation member 2 may have a longitudinal dimension shorter than the corresponding longitudinal dimension of outer channels 1. In such a case, the amount of bouyant material in flotation member 2 is easily altered during manufacture to maintain proper device flotation characteristics. Similarly, volume adjustments are made if the flotation member 2 is a hollow sealed flotation chamber.

Although not shown, the device according to the present invention may have only one outer channel if desired. A longitudinally extending flotation member 2 is not required, for example, flotation member 2 may be ring or donut-shaped or the like.

In FIG. 2, the flotation member end 3 has a larger cross sectional diameter than the outer channels 1.

Figure 3:
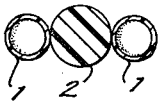
FIG. 3 is a cross-sectional view similar to FIG. 1A.

FIG. 3 shows in a cross-sectional view outer channels 1 joined to a solid flotation member 2. The outer channels 1, circular in shape, have smaller cross-sectional diameters than the circularly-shaped flotation member 2. Other shapes are suitable, and include among others, triangular, rectangular or trapezoidal. Outer channels 1 can have different shapes from each other and flotation member 2.

Flotation member 2 can have a smaller cross-sectional diameter or area than the outer channels 1. In such cases the quantity of bouyant material comprising flotation member 2 may be adjusted during manufacture to maintain proper device flotation characteristics. If a hollow flotation member 2 is desired, than the volume can be similarly adjusted during manufacture.

Figure 4:
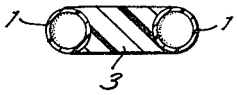
FIG. 4 is a similar cross-sectional view of another embodiment of the present invention.

FIG. 4 shows two outer channels 1 being joined to a flotation member 2 having a non-circular shape although other cross-sectional shapes could also be included.

Figure 5:
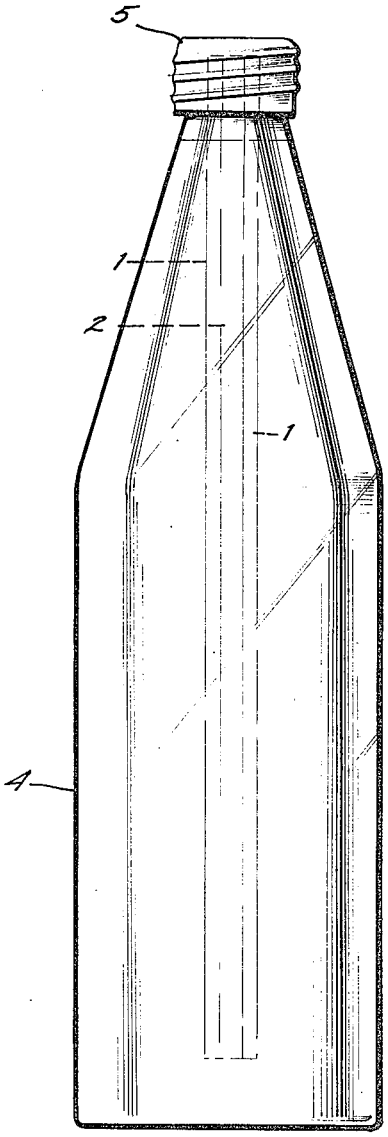
FIG. 5 is a view of a drinking straw of the present invention contained in a closed but releasably sealed bottle or container containing liquid therein.

FIG. 5 shows a bottle or container 4 having a removable closure means 5. This container or bottle 4 will contain a liquid therein. A drinking straw according to the present invention is shown as having outer channels 1 joined to flotation member 2. Such straw is shown as being contained within the bottle or container 4 so that when the bottle or container 4 is filled with a liquid and when the bottle 4 is closed or sealed the straw floats in the liquid with one end against the bottom surface of the closure means 5.

Figure 6:
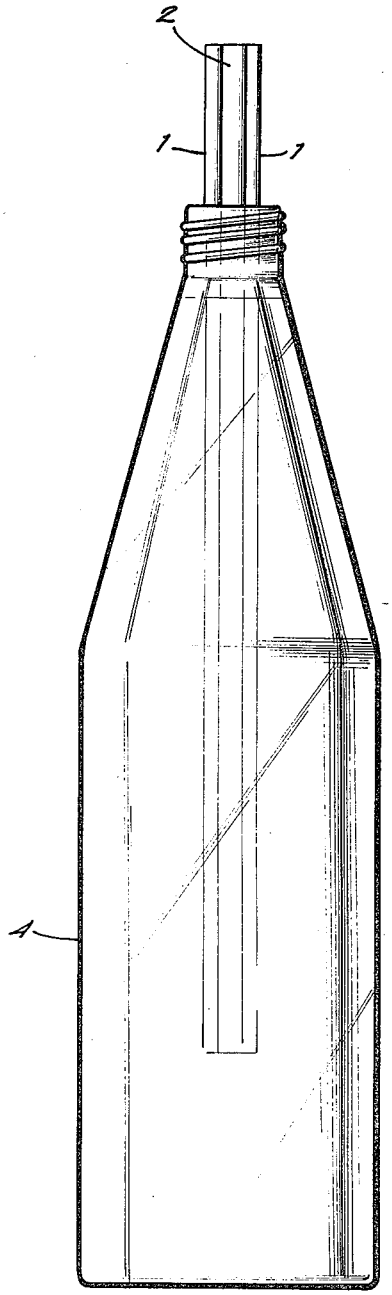
FIG. 6 is a view of a straw according to the present invention in a drinking position following removal of the container closure means shown in FIG. 5.

FIG. 6 shows a straw according to the present invention having outer channels 1 and flotation chamber 2. The straw is protruding outwardly from the rim of the aperture of the bottle or container after the closure means 5 has been removed from container 4.

The main feature of the present invention is that the straw be placed inside the bottle containing the liquid before the bottle or container sealing step.

Preferably the length of the device must be such that the device floats in the liquid in the sealed container with the upper end of the device pressing against the closure element of the bottle or container so that upon opening the beverage container, the upward thrust of the liquid will project the working end of the device a suitable distance outward of the container dispensing aperture. A suitable distance is about 4 centimeters or more. Thus, the total length of the device will depend on the length of the bottle in which the device is placed.

If the device is used as a straw in combination with a container, the user opens the container and one end of the straw sponaneously emerges from the opened beverage container. No further user effort is required. The straw can then be used in normal fashion. When the beverage is consumed the straw falls back into the beverage container. Naturally, the straw must be long enough so that as the beverage is consumed, a working free end remains a useful distance outside the dispensing aperture of the open container.

The preferred and typical diameters of the outer channels 1 and the flotation chamber 2 are preferably about 3 mm to about 4 mm if the device is used as a straw although other dimensions could be used. Dimensions may vary of course depending for example upon the liquid to be drawn through outer channels 1.

The device of the invention can be manufactured using a mandrel capable of simultaneously extruding three longitudinal channels or tubes. After the extrusion process, the continuous tube can be cut to the lengths desired. The central member or flotation chamber is then hermetically sealed at both ends. By such a process, a device having only one outer tube can be easily manufactured. A device with one or more outer tubes joined to a solid flotation member can likewise be prepared by this process.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims, which scope is to be accorded the broadest interpretation so as to encompass all such modifications and equivalent structures.

What I claim is:

1. A straw through which liquid can be drawn comprising at least one extended open channel member having flotation means connected to said channel member which flotation means extends the full length of said channel member for causing the device to float at a predetermined level within the liquid.

2. A straw according to claim 1 wherein said flotation means comprises a solid material having a density less than the liquid drawn through said open channel member.

3. A straw according to any one of claims 1 or 2 including two open channel members.

4. A straw according to claim 3 wherein said two open channel members are joined together by said flotation means.

5. A straw through which liquid can be drawn comprising at least one extended open channel means having flotation means comprising closed chamber means connected to said channel means which flotation means extends the full length of said channel means for causing the device to float at a predetermined level within the liquid.

6. A straw according to claim 5 made of physiologically inert material.

7. A straw through which liquid can be drawn comprising:

two open channel means, and tubular flotation means joined to each of said channel means along their length and having sealed ends for defining a closed chamber having a predetermined volume.

8. A straw according to claim 5 or 7 sealed inside a beverage container with an openable dispensing aperture.

9. A straw for consuming beverages contained in closed or sealed bottles or containers, comprising three tubes of equal length made of plastic or other material and connected along their full length, which may be introduced into a said bottle or container during its filling operation, both ends of one tube being heremetically closed thus forming a flotation chamber while the two remaining tubes are suction tubes allowing suction of the liquid contained in the bottle or container.

10. A straw as in claim 9, characterized in that the suction tubes and the said one tube forming the flotation chamber have a length depending on the length of the bottle or container, so that when the bottle is filled the straw is introduced together with the liquid and when the bottle is closed or sealed the straw floats in the liquid with one end against the bottom surface of the closure means and when the bottle is opened the upper end of the straw spontaneously emerges outwardly from the rim of the aperture of the bottle or container.

11. A straw according to claim 9 or 10 wherein said two suction tubes are non-contiguous while being connected to said flotation chamber.

12. A straw through which liquid can be drawn comprising two open channel members connected to and joined together by a flotation means along the length thereof, said flotation means having wall means for defining a closed chamber of a pre-determined volume for causing the device to float at a pre-determined level within the liquid.

13. A straw according to claim 12 wherein said flotation means extends the full length of said open channel members.

* * * * *